US006241631B1

(12) United States Patent
Wilson

(10) Patent No.: US 6,241,631 B1
(45) **Date of Patent: *Jun. 5, 2001**

(54) FLAG FOOTBALL DEVICE AND COUPLING THEREFOR

(75) Inventor: Wilson C Wilson, Tucson, AZ (US)

(73) Assignee: Sport Supply Group, Inc., Farmers Branch, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/223,833

(22) Filed: Dec. 31, 1998

(51) Int. Cl.[7] ..... A63B 71/00
(52) U.S. Cl. ..... 473/502
(58) Field of Search ..... 473/501, 502; 24/198, 200

(56) References Cited

U.S. PATENT DOCUMENTS

| | | | |
|---|---|---|---|
| 2,966,356 | | 12/1960 | Wilson et al. . |
| 3,251,109 | | 5/1966 | Wilson et al. . |
| 3,345,070 | | 10/1967 | Wilson . |
| 3,355,744 | | 12/1967 | Wilson . |
| 3,579,734 | | 5/1971 | Mehta . |
| 3,579,745 | | 5/1971 | Wilson . |
| 4,304,403 | | 12/1981 | Wilson . |
| 4,651,989 | | 3/1987 | Wilson . |
| 5,245,731 | * | 9/1993 | Funathu ..... 24/200 |
| 5,456,462 | * | 10/1995 | Wilson ..... 473/502 |
| 5,474,301 | | 12/1995 | Wilson . |
| 5,709,621 | | 1/1998 | Wilson . |

* cited by examiner

*Primary Examiner*—Jeanette Chapman
*Assistant Examiner*—M. Chambers
(74) *Attorney, Agent, or Firm*—Jacobson, Price, Holman & Stern, PLLC

(57) ABSTRACT

An arrangement for belts used in flag-tag games includes a new and improved belt buckle which allows for convenient adjustment of belt lengths, as well as a secure and easily adjustable coupling of the two ends of the belt. This is accomplished by providing the belt buckle with an arrangement of slots and struts around which the belt is looped and through which the belt is trained so as to frictionally retain the belt on the buckle while determining the length of the belt. In order to attach the flags to the belt, two suction cup embodiments are employed in which the first fitting having a suction cup with an outward opening is received within a second fitting having a suction cup with an outward opening. In order to facilitate the reliable coupling, one of the cups has a vent so that air is expelled when the cups are coupled. Another embodiment of a coupling for attaching a flag to the belt utilizes a flag with an enlarged end portion which is forced through a rigid loop on the belt when pulled to detach the flag from the belt.

8 Claims, 6 Drawing Sheets

FLAG FOOTBALL DEVICE AND COUPLING THEREFOR

CROSS-REFERENCE TO RELATED PATENTS

This application is related to U.S. Pat. Nos. 2,966,356, 3,251,109, 3,279,745, 4,304,403, 4,651,989 and 5,456,462 issued to the inventor of this application. The disclosures of these patents are incorporated herein by reference in their entirety.

BACKGROUND OF THE INVENTION

This invention relates to novel flag-tag devices and to improved couplings for flags as well as and an improved belt buckles for such devices.

Games utilizing "chase-catch" instincts are as old as civilization. One of the most elaborate and complicated is the game of football as played in the United States of America. Rules in the game provide fair and equal opportunities to win, and along with the demands of strategy and physical skills, combine to make football a favorite sport in the United States. Unfortunately, this great game has been mostly a "spectator" sport.

The reason for this is that the playing of tackle football requires extensive heavy body contact, as well as extensive falling or rolling contact with the ground. Thus, the tackle version of the game of football requires much physical conditioning and expensive safety equipment. These are factors which make mass participation in this version of the game impossible.

An alternative version has been played with requires stopping of the ball carrier by a two handed "tag" or "touch", and this, in combination with modified blocking rules has allowed less restricted participation in the game. However, this game becomes less exciting because the ease with which the "touch" or "tag" is made prevents the ball carrier from going forward into or through a group of components.

Still another alternative involves stopping the ball player by removing a tail, streamer or flag from the body. However, these flags, in order to make the game exciting, must detach only after use of the same approach as in making a good tackle in the "tackle" version of the game.

The ideal is to provide a set of flag devices which spin, spiral and flutter so as to be elusive, and which ideally requires a pull-away tension of 15–20 lbs. The flags should require an "along-side" approach with a center flag grasp and clean jerk-away to accomplish deflagging. If these standards are required, this will make the game exciting and will make it available for safe mass participation of people of both sexes and all ages. As noted before, such devices are generally illustrated by the above-identified patents of the same inventor.

In prior flag type games, a flag has typically been attached to the belt or other waist-encircling arrangement of a wearer by relatable coupling parts in a manner such that the flag is pulled away from its attachments to the belt by a predetermined pull-away tension to the belt. This serves to detach the flag coupling part from the cooperative belt coupling part. Normally, these coupling parts have been designed as cooperating ball and socket devices, as shown in U.S. Pat. Nos. 2,966,356, 3,251,109, 3,345,070, and 3,579,734. Such coupling parts are typically formed of plastic material and it has been found that where resiliency of the socket part is relied upon for the attachment and release of the ball part, the resiliency varies under different conditions of climate and particularly in colder climates, where the socket part may shrank to such a degree that the pull-away force to separate the coupling part becomes excessive, this creates substantial problems in using the device.

By enlarging the socket or female part as compensation, other problems are created and results in non-uniform performance of the coupling in varied climates.

Bifurcating the ball does not fully solve the problem and reduces the durability of the ball.

In a more recent improvement in this type of device, as evidenced by the device of U.S. Pat. No. 4,304,403, a ball member is provided with an open-ended through slot to provide resiliency to the cheeks of the ball to permit manual attachment and detachment thereof relative to the socket member. An attachment member is positioned by an angled portion extending outwardly of the belt of a player to secure the end of a game flag or similar game piece thereto.

Although providing an improvement over the above-discussed prior art devices, it has been found that even this type of ball and socket coupling assembly will wear out as a result of time and although the problems with respect to changes in climate are somewhat ameliorated, the same problem still exists, but on a lesser scale. Furthermore, even with this type of device, should it be functioning properly, it has also been found that a disadvantage of use thereof is that many times in the excitement of the game the person wearing the device and having the flag detached therefrom will not notice the tug, and continue playing thereby delaying the game unnecessarily.

In other prior flag-tag games, another problem has been that the belts in use generally need to be constructed of several different sizes. First sizes for smaller players with smaller waists who would not be able to wear larger sizes for use by adult-type players. A second size is used for adult-type players which when used on smaller players results in a dangling extension of the belt which is often mistaken for a flag and pulled upon to down the player.

One belt design which attempts to correct this problem is disclosed in U.S. Pat. No. 3,355,744 and describes a belt and engaging member onto which the excess belt amount can be looped to prevent the belt end from flopping during the games. However, it is often the case that the user will forget to engage the belt in said element, thereby defeating the purpose of this provision.

SUMMARY OF THE INVENTION

It is thus an object of this invention to provide equipment for flag football and comparable games that enables set standard tension separation, of the flags from a player, while at the same time ensuring secure coupling on a repetitive basis.

It is another object to provide a safe plastic flexible belt buckle or fastener that is economical to manufacture, and which further, can be used effectively by players of all sizes. The buckle can be used with wide or thin belting whose color can be easily seen over the entire playing area. The buckle provides for automatically securing excess loose running and belting loop behind the buckle. Thus, players can no longer forget to secure loose ends of the belting.

It is still another object of the invention to provide a combination flag football and comparable game apparatus that includes the above-discussed improved coupling as well a safe plastic flexible belt buckle or fastener with the belt buckle or fastener providing for both gross and fine adjustments of the length of the belt. Accordingly, automatic and instantaneous adjustment to all waist sizes is incorporated into this design.

Still further, another object is the reduction in the use of unnecessary equipment by providing identifying markings on the equipment.

In one aspect, the invention is an improvement in a flag-tag game deice having a support member for attachment thereof to the belt of a player, and a game piece detachable from the support member at a coupling. The coupling (flag to belt) is constructed to use atmospheric pressure and friction to attain the above-discussed 15–20 lbs. break-away tension for the flag. In addition, the device is designed with nested cups to produce a loud "pop" noise on detachment which improves the game for spectators and officials by providing instant proof of deflagging. The components of the nested cups are made of soft, resilient wear resistant plastic to reduce wear from repeated insertions and detachments and at least one of the cups has a vented bottom.

The pull-away of the flag is of a nature which automatically imposes a correct "tackle" type approach. A firm grasp and clean jerk away is required. The device relies on vacuum holding force such that interior vacuum will reseat the connection members if there is any pause in disengagement and if the pull-away is slow. This feature may be enhanced by having within one cup a projection and within the other cup a socket for receiving the projection.

The improvement in the one aspect is directed to the coupling which comprises a first element fixedly attached to the support member and comprises a flexible cup-shaped structure having a greater inside wall-to-inside wall dimension adjacent the interior base of the cup-shaped structure than the wall-to-wall dimension adjacent the opening thereof A second element adapted for detachably coupling with the cup-shaped member is also provided. This second element corresponds at its exterior to the shape of the first element to fit sufficiently tightly therein to create a suction-generated force holding the second element inside the first element. Thereby, forces tending to pull the first and second elements apart are resisted. To facilitate the coupling connection, one cup-shaped member includes a bottom with a vent.

In a more specific aspect, the amount of suction generated can be controlled and further, when separated, the elements generate a "popping" noise which signals when the elements have separated, facilitating the playing of the game.

In accordance with one embodiment of the present invention, a belt for use in a flag-tag game comprises a length of flexible material in the form of a web, sufficiently long to encircle the waist of a player of the game and having at least one removable flag attached thereto. A first end portion of the belt has a slot therein wherein the belt is inserted through the slot to form an adjustable loop which is connected to a buckle, while a second end portion of the belt has a leading edge which is detachably connected to the buckle. The buckle comprises a body portion having a mid-portion, a first end and a second end. The first end has a pair of closed slots separated by an intermediate strut and a first partially open slot outboard of the closed slots. The body further has a single closed slot adjacent the second end with a friction element associated with the single slot, as well as a second partially open slot outboard of the single closed slot. The loop formed at the first end of the belt extends through the pair of closed slots and is looped around the intermediate strut, separating the pair of closed slots. In order to attach the second end of the belt to the buckle, the leading edge of the second end is fed through the single closed slot at the second end, over the mid-portion of the body and strut separating the pair of first slots, through one of the first slots and around the strut separating the pair of first slots from the first partially open slot in the first end. The belt is then passed through the partially open slot at the first end, back over the body and through the second partially opened end slot. Consequently, the belt as an adjustable length selected by accumulating a substantial selected length of the belt in the loop and a frictional coupling with the buckle that maintains the selected length when lateral stress is applied to the belt in an attempt to move the flag.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
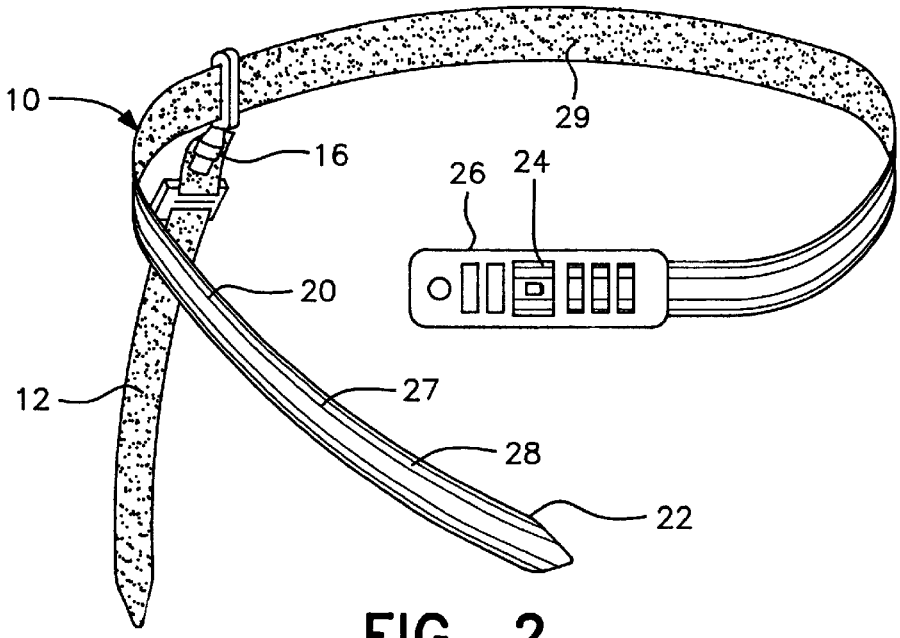
FIG. 1 is a perspective view of a first embodiment of the flag-tag belt in accordance with the present invention shown in an open condition.
Figure 2:
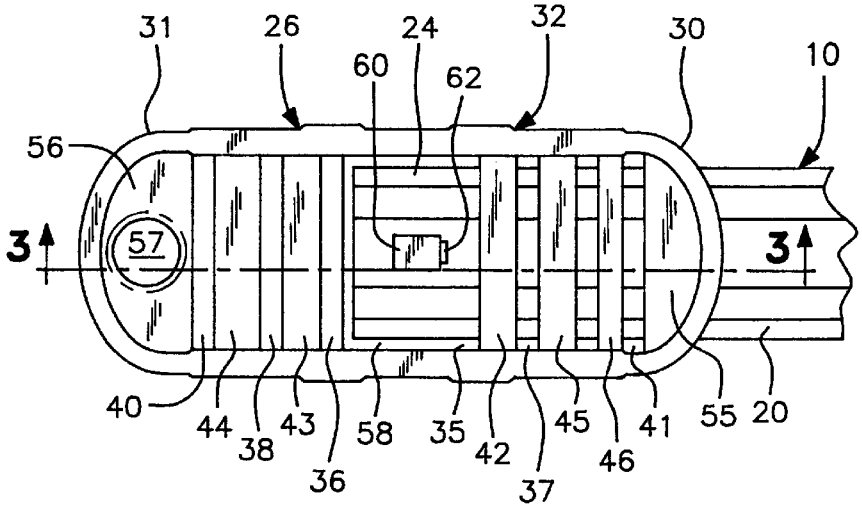
FIG. 2 is a front view of a buckle used with the belt of FIG. 1 having a second end portion of the belt attached thereto.

Referring now to FIG. 1, there is shown a first embodiment of a belt 10, in accordance with the present invention, which is used in play flag tag games wherein at least one flag 12 is detachably mounted to the belt by a coupling 16. The belt 10 has an elongated web portion 20 having a first end portion 22 and a second end portion 24, which are joined by a buckle 26. The belt 10 is preferably made of a plastic material such as polyethylene terafilate, reinforced polyvinyl chloride (PVC) or vinyl resins including PVC. In the embodiment of FIGS. 1–5, the belt has four ribs 27 extending along the outside surface 28 thereof with the inside surface 29 being smooth. Referring now mainly to FIGS. 2–5, the buckle 26 includes a first end 30 and a second 31 joined by a middle section 32. The belt buckle 26 has a first slot 35, a second slot 36, a third slot 37, a fourth slot 38, a fifth slot 39, a sixth slot 40 and a seventh slot 41. Separating the slots 35–41 are first strut 42, second strut 43, third strut 44, a fourth strut 45 and a fifth strut 46. Adjacent the first end 30 of the buckle 26, there is a land 55 and adjacent the second end 31 there is a land 56 which has a hole 57 therethrough for hanging the belt 10 on a wall hook, or the like. A central land 58 is disposed between the slots 35 and 36 and has a stud 59 projecting therefrom which has a head 60. The head 60 is used to secure the end 24 of the belt 10 to the first land 60 by passing through an aperture 62 in the first end of the belt. A rim 64 extends around the periphery of the belt buckle 26.

Figure 3:
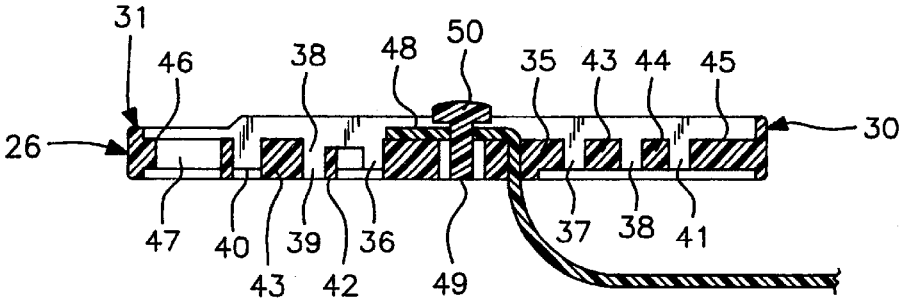
FIG. 3 is a side view of the buckle of FIG. 2.
Figure 4:
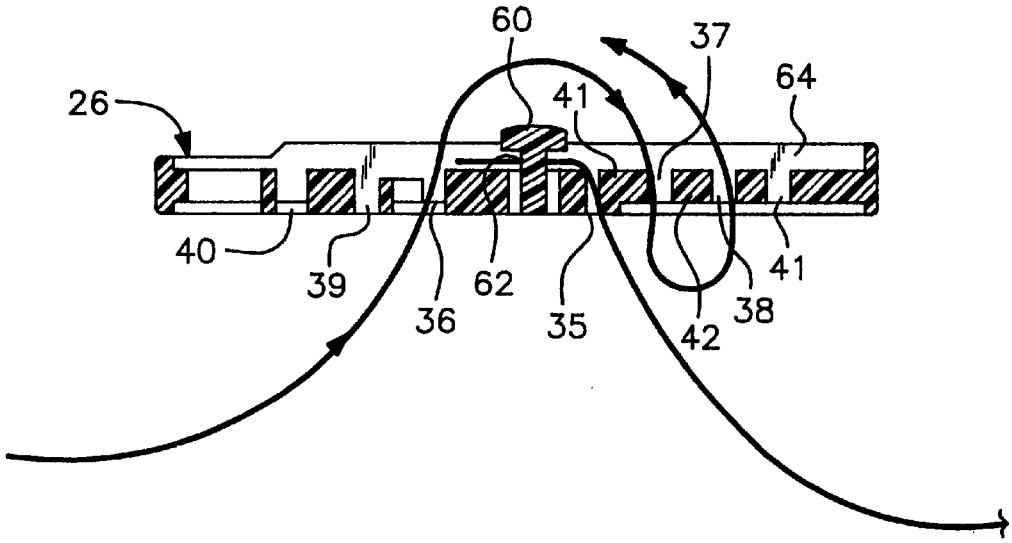
FIG. 4 is a side view showing attaching the free end to the buckle.
Figure 5:
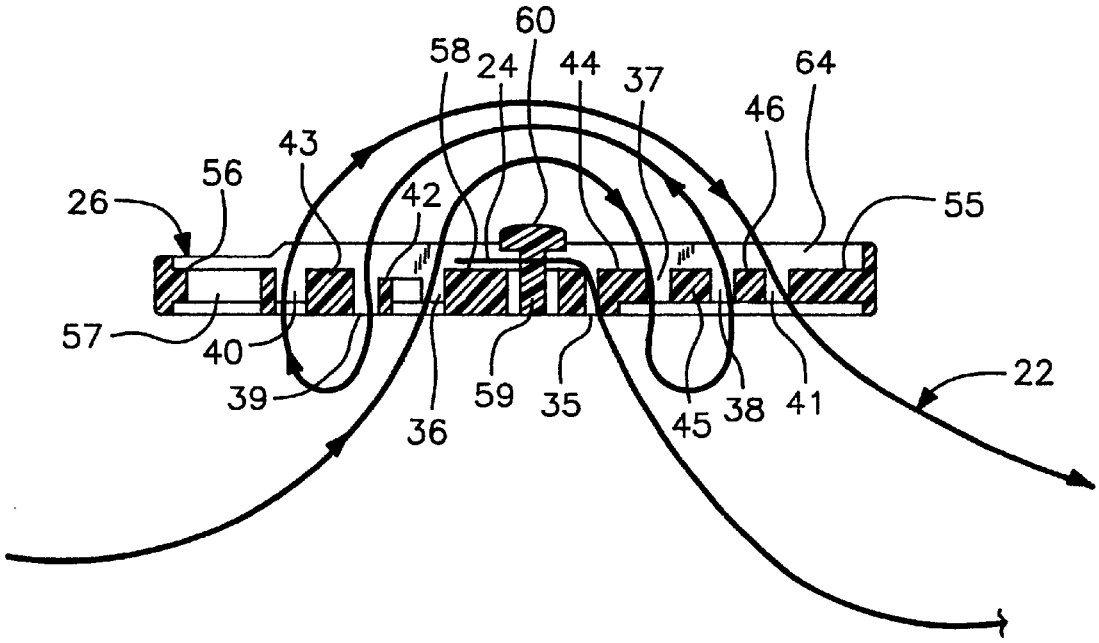
FIG. 5 is a view similar to FIG. 4, but showing the belt trained through slots in the buckle.
Figure 6:
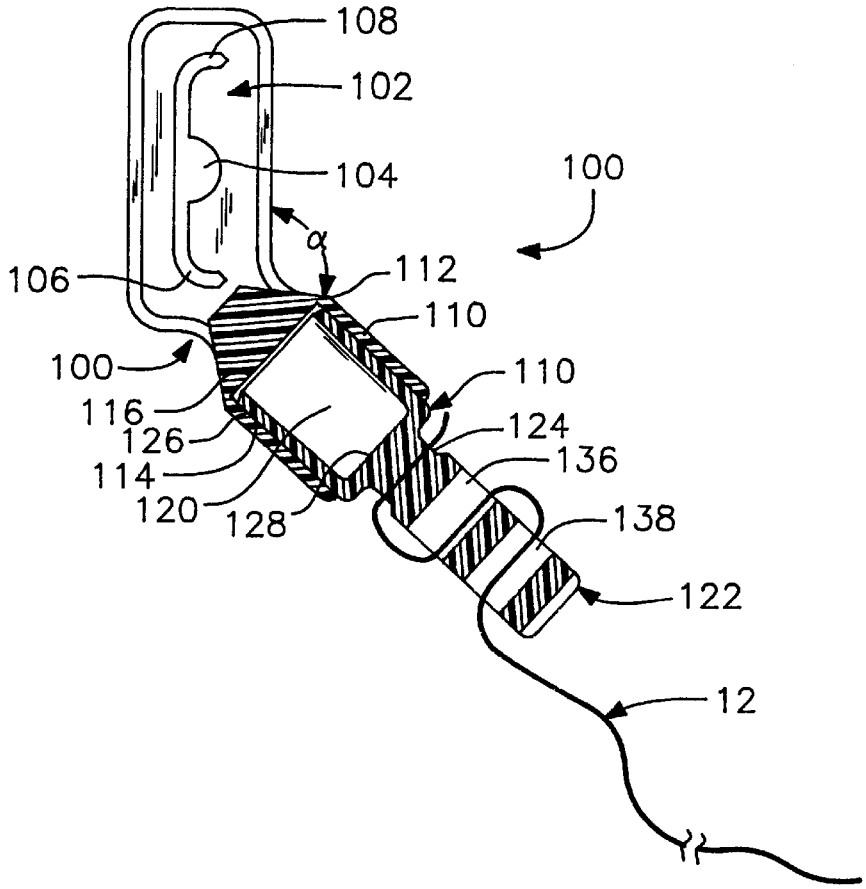
FIG. 6 is a side view showing a first embodiment of a coupling arrangement for coupling a flag to the flag-tag belt, showing the coupling connected.

As is seen in FIGS. 3, 4 and 5, the end 24 of the belt 10 is passed through the first slot 35 either prior to or after anchoring the end with the belt with the head 60 of the stud 59. The end 22 of the belt is then attached to the belt buckle 26. This is done so that a substantial length of the belt 10 may be accumulated on the belt buckle 26, if the length of the belt is such that in order for it to fit on the player, the free end 22 of the belt will dangle loosely from the buckle. In order to accumulate a substantial portion of the belt's length on the buckle, it is threaded back and forth through the buckle as is seen in FIG. 5.

As is seen in FIG. 4, the free end 22 of the belt 10 is initially threaded through the second slot 36, passed over the head 60 of the stud 59. Depending on the waist size of the wearer, the end 22 of the belt 10 may then be passed out through the seventh slot 41 or may be passed through the second slot 37. The belt 10 can then loop around the strut 45, passed through the third slot 38 and then over itelf and through the fourth slot 39. If there is still excessive length in the belt 10, the belt can then be looped around the strut 44 and passed through the fifth slot 40 before again being passed over itself and inserted through the sixth slot 41 in the belt buckle 26. Consequently, the belt buckle 26 can accumulate about one foot of belt length thereon and thus keep the end 22 of the belt from dangling if the player has a relatively narrow waist. For larger players, the belt need not be threaded through all of the slots and the end of the belt can rather be inserted through a loop or other fitting such as the bracket 70 shown in FIG. 1 which has a couple of inwardly projecting pins 71 an 72 beneath which the free end 22 of the belt can be retained.

By having the belt buckle retained to the end 24 on the middle land 58 by the stud with the head 60, the buckle 26 can be pivoted adjacent its ends 30 and 31 so as to alternatively expose the back side of the buckle in order to facilitate ease of inserting the belt 10 through the slots 36–41.

Referring now to FIGS. 6–9, there is shown a first embodiment of a suction coupling 100 for coupling at least one of the flags 12 to the belt 10. The suction coupling 100 includes a slider support 102 which receives the web 20 of the belt 10 through a slot 104. The slot 104 has a sufficient width to receive a relatively thick, one inch width belt or a relatively thin but wider belt, which extra width is accommodated by the bends 106 and 108 in the slot 104. Projecting at an oblique angle with respect to the slider support 102 is a first suction cup 110 which is unitary with and molded from the same material as the slider support. By orienting the opening 112 of the suction cup 110 outwardly or away from the slider support 102, the expense of making the coupling, which is attached to the belt 10, is greatly reduced. This is because there is no need to weld the cup 110 to the slider 102, which was necessary in the prior art suction cup couplings.

The suction cup 110 has a cylindrical side wall 114 which is relatively thin and a base 116. The cup 110 and mounting slider 102 form a first portion of the suction coupling 100.

Figure 8:
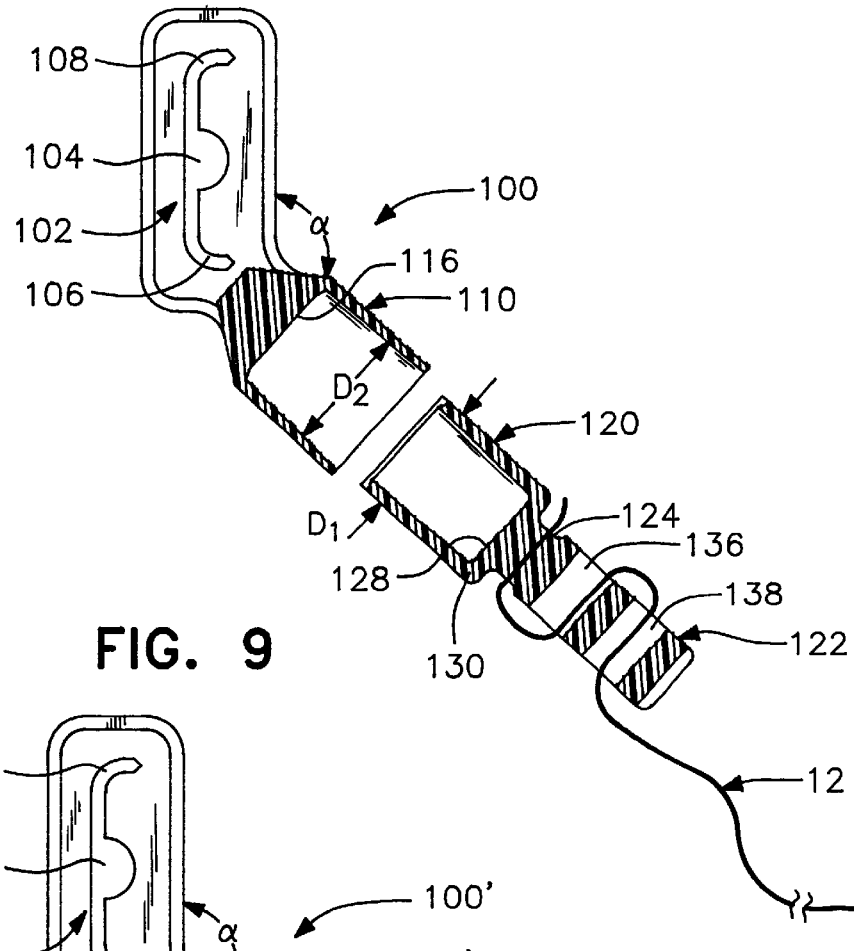
FIG. 8 is a side view similar to FIG. 6, showing the coupling disconnected.

The second portion of the suction coupling 100 is the attachment comprised of a suction cup 120 and a flag attachment buckle 122 which is attached to the suction cup 120 by a stem 124. Suction cup 120 has a cylindrical wall 126 which is relatively flexible base 128. As is seen in FIG. 8, the suction cup 120 has an outer diameter D1 which complements the inner diameter D2 of the suction cup 110. Consequently, the suction cup 120 is snugly received within the suction cup 110. In order to facilitate easy insertion of the suction cup 120 into the suction cup 110, an air hole 130 is formed in one or both of the bases 128 or 116, of the suction cups 120 and 110. When the suction cups are inserted and pressed together, air trapped within the confines thereof vents through the air hole 130 as the suction cups are axially slid together. When the suction cups are pulled apart by yanking on one of the flags 12 or 14 attached to the buckle 122, there is audible report or "pop" as the suction cup 120 rapidly disengages from the suction cup 110.

Figure 7:
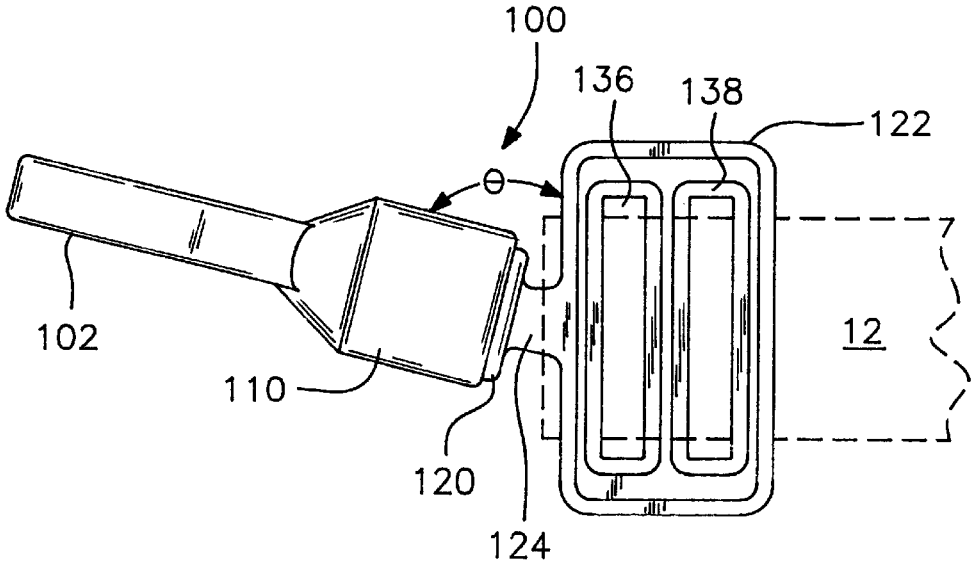
FIG. 7 is a side view similar to FIG. 6, showing the coupling oriented at 90° to FIG. 6.

As is seen in FIG. 7, in order to enhance the pop, the buckle 122 is also offset at an angle $\Theta$ from the suction cup 120. This increases friction between the walls 126 and 114 when the 12 flag attached to the buckle 122 is yanked, thus increasing the force and, therefore, the loudness of the sonic pop. Further to this point, by having the flag attachment buckle 122 offset by both angle $\Theta$ and angle $\alpha$ with respect to the slider support 102, the flag 12 extends at a double oblique angle with respect to the belt which results in a louder "pop" when the suction cups 110 and 120 separate. When the slider support 102 is on the belt 10 as is shown in FIG. 1, with the slots 136 and 138 of the attachment buckle 102 extending at 90° as is seen when comparing FIGS. 6 and 7, there are twisting and bending forces on the suction coupling 16 which result in an increased separation force and in the louder "pop."

Figure 9:
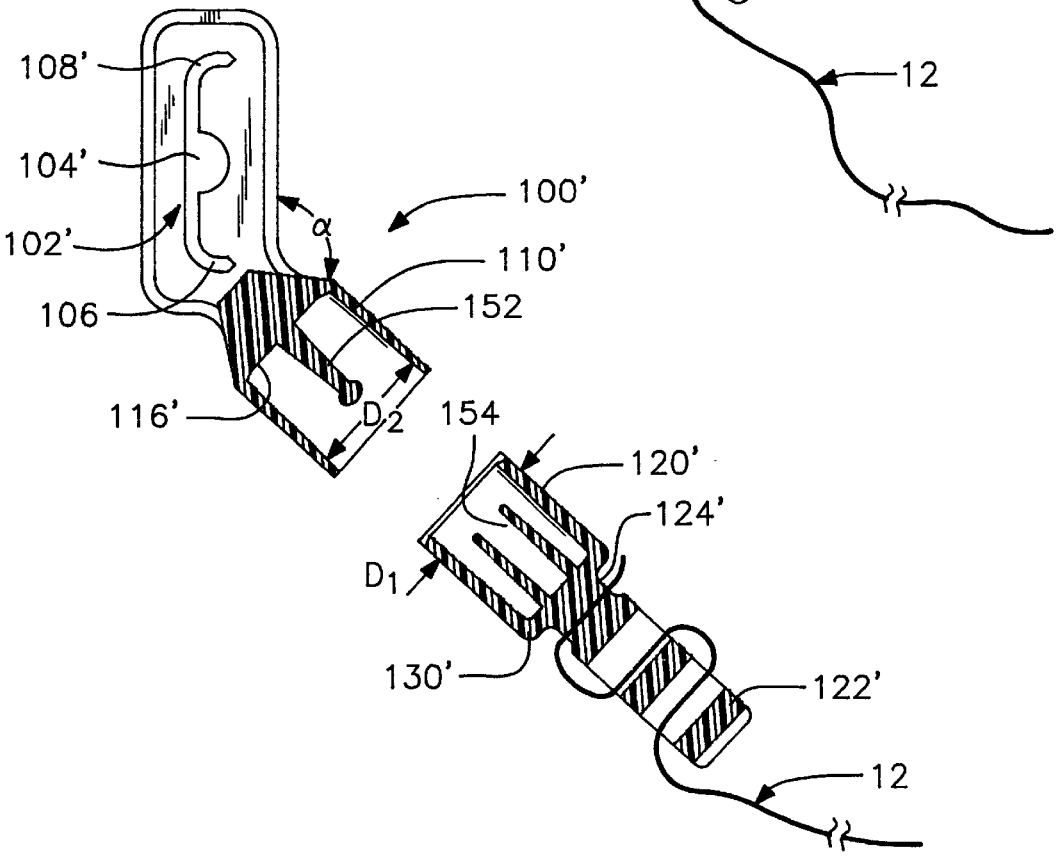
FIG. 9 is a side view similar to FIGS. 6 and 8, showing another embodiment of the coupling arrangement for flags which uses a socket and projection.

Referring now to FIG. 9, there is shown suction coupling 100' in accordance with a second embodiment of the couplings 16 attaching the flags 12 to the belt 10. The second suction coupling 110' is substantially identical to the first suction coupling 100, but includes a projection 152 in the suction cup 110' which is received in a socket 154 in the suction cup 120'.

Figure 10:
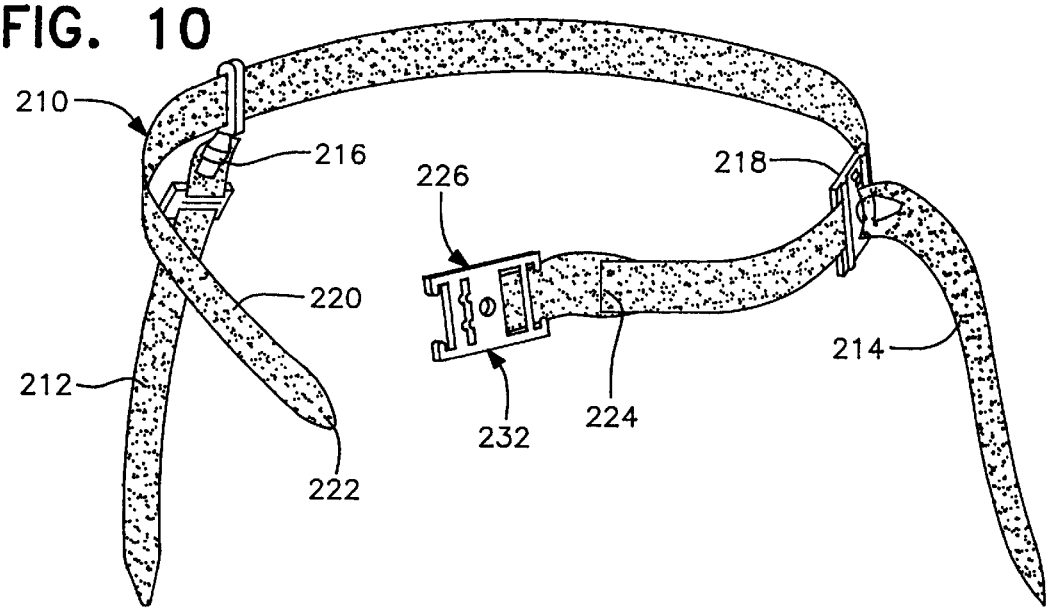
FIG. 10 is a perspective view of a second embodiment of the flag-tag belt in accordance with the present invention shown in an open condition.

Referring now to FIG. 10, there is shown a second embodiment of the invention which uses a belt wherein at least one flag 212 or 214 is detachably mounted thereon by a suction coupling 216 or optionally, by a second type of coupling 218 to be further discussed hereinafter. The belt 210 has an elongated web portion 220 having the first end free end portion 222 and a second end portion 224 which are joined by a buckle 226. The belt 210 is preferably made of a plastic material such as polyethylene terephthalate, reinforced polyvinyl chloride (PVC), or vinyl resins including PVC.

Figure 11:
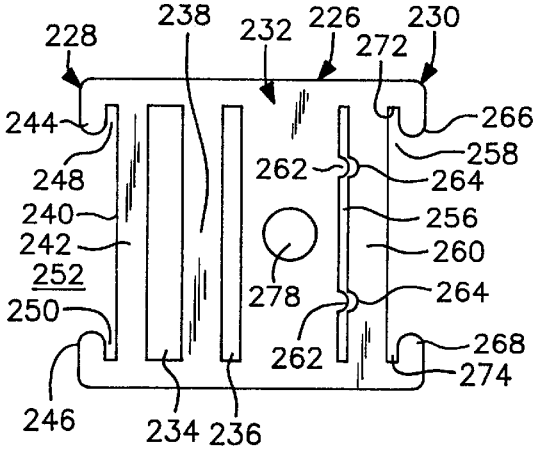
FIG. 11 is a front view of a buckle used with the belt of FIG. 10.
Figure 12:
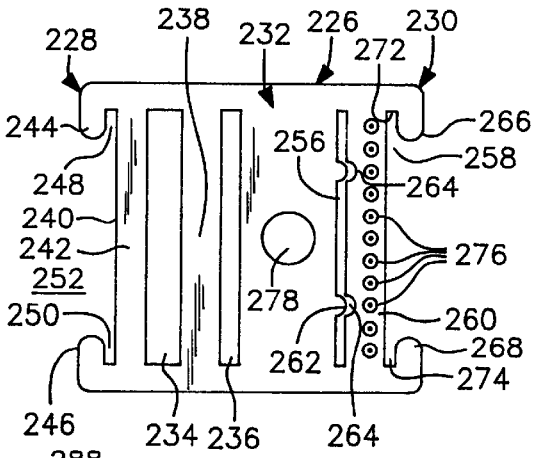
FIG. 12 is a rear view of the buckle of FIG. 10.

Referring now to FIGS. 11 and 12, where the front and back views of the buckle 226 are shown. The buckle includes a first end 228 and a second end 230 joined by a mid-section 232. A pair of slots 234 and 236 are disposed proximate the first end 228 and are separated by an intermediate strut 238. An open slot 240 is positioned outboard the pair of slots 234 and 236 and is separated therefrom by a strut 242. The open slot 240 has its ends defined by lips 244 and 246, which define recesses 248 and 250 therebehind and are spaced by an opening 252.

At its second end 230, the buckle 226 has a single slot 256 which is separated from an end slot 258 by a strut 260. The single slot 256 has a pair of teeth 262 therein with rounded ends which oppose a pair of indentations 264 in the strut 260. The second open slot 258 is similar to the first open slot 240 in that it has lips 266 and 268 that are separated by a space 270 and which define recesses 272 and 274 thereunder. As is seen in FIG. 12, the buckle 226 has a row of conical projections 276 thereon which are pointed for engagement with the web 20 (FIG. 10) of the belt 210. The buckle 226 also has an aperture 278 therethrough which receives a hook (not shown) for hanging the belt 220.

Figure 13:
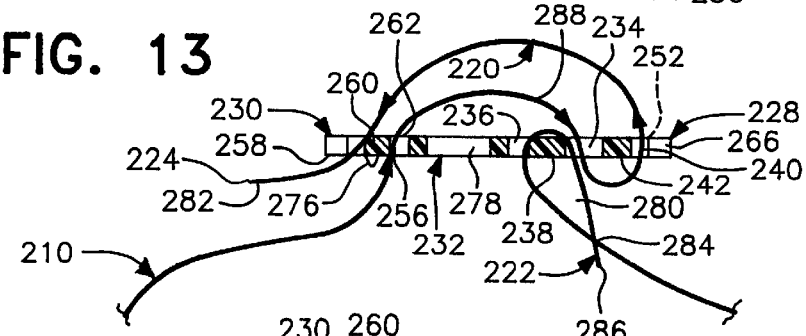
FIG. 13 is a side view of the buckle showing attaching the free end of the belt to the buckle by training the belt through slots in the buckle.

Referring now to FIG. 13, it is seen that the first end of the belt 210 is formed into a loop 280 by inserting the tapered leading edge 282 of the second free end 224 of the belt through a slit 284 adjacent the tapered free edge 286 of first end 222. The loop is formed around the strut 238 with the web 220 of the belt passing through the slots 234 and 236. By adjusting the length of the loop 280 so as to accumulate either more or less of the web 220 of the belt 210, the length of the belt is selected.

In order to attach the second end 224 of the belt 210 to buckle 226, second end 282 is first passed through the single slot 256 at the second end 230 of the buckle from the underneath or backside of the buckle. The leading edge 282 of the web 220 is then passed through the slot 236 of the pair of slots 234 and 236 from the front side of the buckle over the loop 280. The web 220 is then inserted in the open slot 252 at the first end 228 of the buckle 226 and then passed back over belt portion 288 and the mid-portion 232 buckle and inserted through the second open slot 258 at the second end 230 of the buckle. If there is substantial length of the second end portion 224, it is simply tucked behind the web 220 of the belt.

Figure 14:
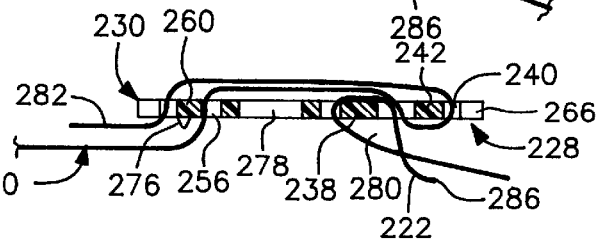
FIG. 14 is a view similar to FIG. 13, but showing the belt pulled taught.

When the web 220 of the belt 210 is inserted through the single slot 256 and pulled so as to be slightly tensioned about the wearer's waist, the frustoconical projections 276 on the rear face of the buckle 226 bite into the web to help restrain the web. The portion of the web 288 formed when the end 224 is passed through the slot 236 is tensioned when the second end 224 is pulled tight. This causes the teeth 262 to press into the web 220 and firmly fix the length of the belt 210. The end 224 is then passed through the open slot 40 and again pulled tight to flatten the belt portion 288, as is shown in FIG. 14. Finally, the end portion 224 is folded over the portion 288 and passed through the second open slot 258 and tensioned. If the end portion 224 is excessively long, then it can be tucked beneath the web 220 of the belt 210.

Figure 15:
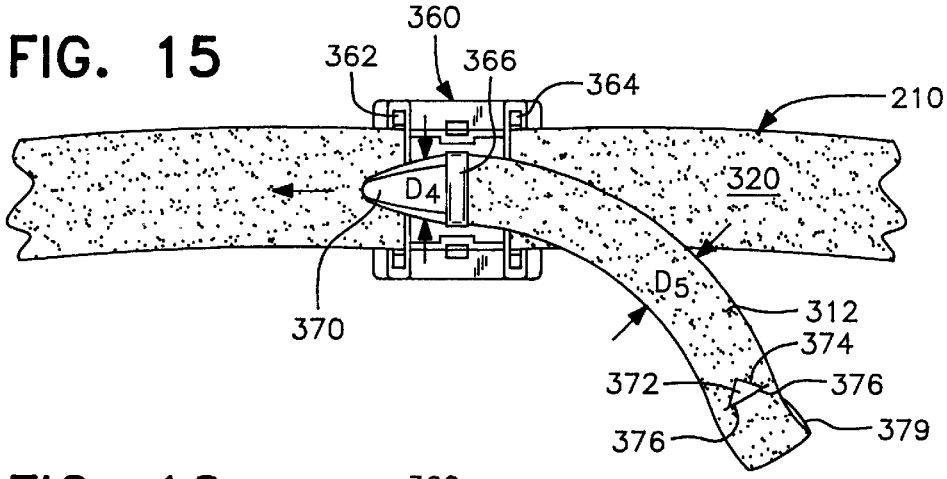
FIG. 15 is a perspective view of a second embodiment of a flag coupling arrangement showing a flag being inserted in a loop on the belt.
Figure 16:
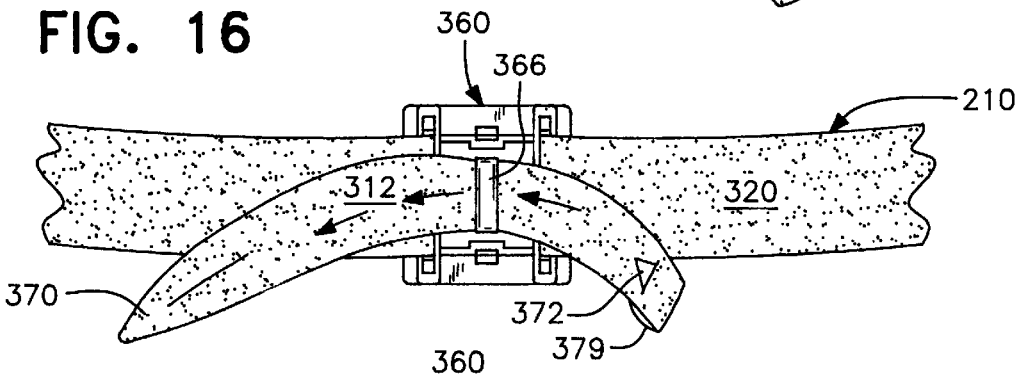
FIG. 16 is a view similar to FIG. 15 showing the flag being pulled through the loop.
Figure 17:
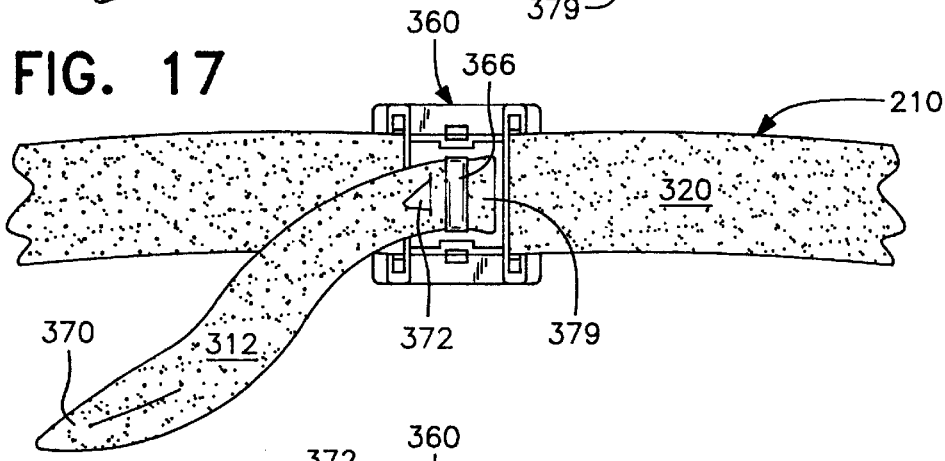
FIG. 17 is a view similar to FIGS. 15 and 16 showing the flag positions in the loop and ready for play.
Figure 18:
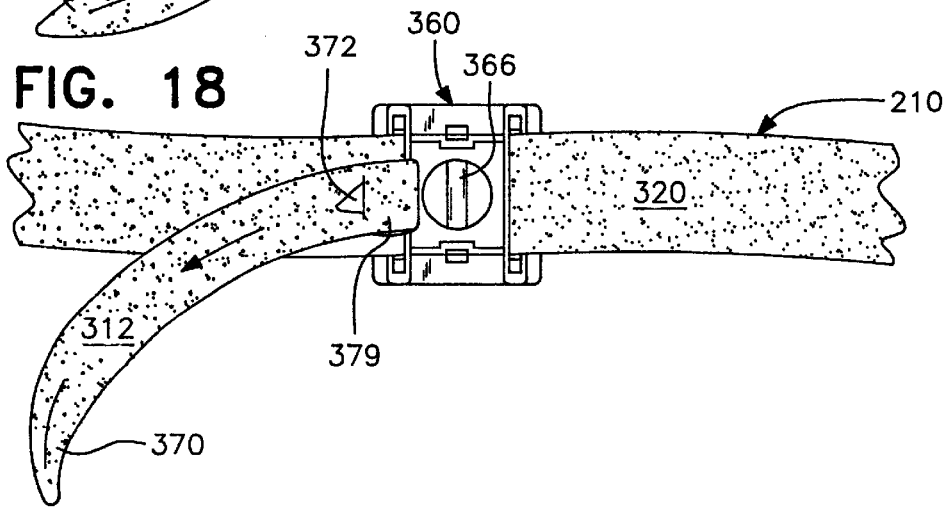
FIG. 18 is a view similar to FIGS. 15–17 showing the flag being pulled from the loop during play.

Referring now to FIGS. 15–18, there is shown a second embodiment of structure for attaching the flags 312 to the belt 210, which is considerably less expensive than the embodiments of FIGS. 6–9. In this embodiment, a buckle 360 having slots 362 and 364 therein for receiving the web 320 of the belt 210 has a relatively rigid loop 366. The relatively rigid loop 366 has a selected fixed diameter D4 which is less than the width D5 of the flag 312. The flag 312 has a tapered leading edge 370 which is passed through the loop 366 to attach the flag 312 to the belt 210. The flag 312 has a trailing end 372 which includes a tapered trailing edge 374 having a pair of slits 376 which extend laterally inward from the edges of the flag 312. Behind the slits 376 is a slot 378 in the flag 312 through which the tapered trailing edge 374 is inserted so that the slits hold this trailing end 372 in a loop 379. As is seen in FIG. 17, the trailing end 372 of the flag 312 is enlarged by the loop 379 in order to hold the flag in the loop 366 of the buckle 360. As is seen in FIGS. 15 and 16, the flag 312 is pulled through the loop 366 of the buckle until the loop 379 of the flag engages the loop 366 of the buckle. As is seen in FIG. 18, when tension is applied to the flag 212, the enlarged portion formed by the loop 379 is squeezed so as to slide through the loop 366 and free the flag 212 from the belt 210. While this approach does not provide for the "pop" of the suction coupling of FIGS. 6–9, it does provide a relatively inexpensive flag-tag arrangement.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A belt for use in a flag-tag game in which at least one flag is detachably connected to the belt, said belt comprising:

a length of flexible material in the form of a web sufficiently long to encircle the waist of a player of the game and having at least one removable flag thereon, the belt having a first end and a second end;

a first buckle having a first end, a second end a middle portion, the middle portion having the second end of the belt attached thereto;

a plurality of slots in the first buckle between the fist end and the middle portion and between the second end and the middle portion whereby the first end of the belt is attached to the first buckle by being passed through the slots selectively and looped over itself on the first buckle to accumulate a selected portion of its length on the first buckle;

at least one support on the web for detachably supporting a flag thereon, the at least one support including a suction coupling having a first suction coupling portion integral with the support on the web and a second suction coupling portion integral with a second flag attachment buckle for holding the flag, the support on the web including a closed slot with the web extending therethrough and the first suction coupling portion including a flexible first cup having a cylindrical side wall offset at an oblique angle with respect to the closed slot and the second suction coupling portion including a flexible second cup having a cylindrical side wall nesting within the cylindrical side wall of said first cup, said second flag attachment buckle being offset by an oblique angle with respect to the second cup so that the flag attachment buckle is offset by both of said oblique angles with respect to the support and the flag extends at a double oblique angle with respect to the belt resulting in increased friction between the sidewall of the first cup and the side wall of the second cup requiring increasing force when the flag is yanked and therefore increased loudness of a pop created when the first cup and the second cup are separated as caused by twisting and bending forces on the suction coupling between the sidewalls of the first and second cups.

2. The belt of claim 1, wherein the web is unperforated.

3. The belt of claim 1, wherein the first buckle has a hole therein for receiving a projection to hang the belt.

4. The belt of claim 1, wherein the flag is detachably secured to the second portion of the coupling.

5. The belt of claim 4, wherein the flag has an end attached to the second coupling which is defined by a tapered end with a slot therein which tapered end and slot cooperate to attach the flag.

6. The belt of claim 5, wherein the second end of the belt is fixed to the front side of the first buckle and passed through one of the slots to the back side of the first buckle and wherein the first end of the belt is passed initially through the back side of the belt and passed over the second end before being looped through a pair of adjacent slots.

7. The belt of claim 5, wherein the cups each have a bottom and wherein there is a vent hole through at least one of the bottoms.

8. The belt of claim 7, wherein one of the cups has a projection therein and the other cup has a socket and wherien when the cups are nested one within the other, the projection is received in the socket.

* * * * *